United States Patent [19]

Buschfeld

[11] 4,353,416

[45] Oct. 12, 1982

[54] PRESS PLATE FOR PLATEN PRESSES

[75] Inventor: Herbert R. Buschfeld, Kaarst, Fed. Rep. of Germany

[73] Assignee: G. Siempelkamp GmbH & Co., Krefeld, Fed. Rep. of Germany

[21] Appl. No.: 238,666

[22] Filed: Feb. 27, 1981

[30] Foreign Application Priority Data

Feb. 28, 1980 [DE] Fed. Rep. of Germany ..... 3007493

[51] Int. Cl.[3] ..... B30B 15/06; F28F 3/12

[52] U.S. Cl. ..... 165/168; 100/93 P; 425/406; 425/407; 156/583.1

[58] Field of Search ..... 100/93 P, 295; 425/406–411, 383–385, 547, 810; 165/165, 168, 170; 156/580, 583.1, 583.5–583.9

[56] References Cited

U.S. PATENT DOCUMENTS 2,699,325 1/1955 Hedin ..... 165/168
4,023,481 5/1977 Keeny ..... 100/93 P
4,264,293 4/1981 Rourke ..... 425/407

FOREIGN PATENT DOCUMENTS 1916505 8/1970 Fed. Rep. of Germany ..... 165/168

*Primary Examiner*—Peter Feldman
*Attorney, Agent, or Firm*—Karl F. Ross

[57] ABSTRACT

A heating press plate for a multilevel or multistage platen press is formed with passages, traversed by a heating fluid, e.g. superheated steam. According to the invention, these passages are formed by paired parallel bores with the bores of each pair being separated from one another by relatively thin partitions, webs or ribs, and the pairs of bores being separated by relatively thick partitions, walls or ribs, the bores of each pair being traversed by the fluid in the same direction while the bores of adjoining pairs are traversed by fluid in opposite directions. Connecting chambers bridge adjacent pairs of bores and the relatively thin partition is set back from the chamber to provide mixing zones in which the bores of each pair communicate with one another before they open into the respective chambers.

6 Claims, 4 Drawing Figures

PRESS PLATE FOR PLATEN PRESSES

FIELD OF THE INVENTION

The present invention relates to a press plate for a platen press and, more particularly, to a heating plate which can be used as the press platen in a single-level or as one of the heating platens of a multilevel press plate.

BACKGROUND OF THE INVENTION

Presses for the hot pressing of flat objects, in the form of platen presses, are provided in a variety of configurations and with one or more heatable press plates or platens. Reference may be had to the following United States patents and the literature cited in the files thereof or referred to in the respective texts: U.S. Pat. No. 3,687,788, No. 3,619,322, No. 3,428,505, No. 3,517,610, No. 3,565,725, No. 3,914,079 and No. 3,989,581.

From the foregoing, it will be apparent that heatable press plates can be used in so-called single-level or single-stage presses, in which the article to be pressed is received between a bed plate and a head plate, at least one of which is heated on a tray, on a conveyor or directly, with either the head plate or the bed plate, or both being movable to press the article between them.

Double-level or two-stage presses can also be provided with two articles received between an intermediate press plate and the bed plate and head plate respectively.

Heatable plates are also used in multistage or multilevel presses in which, between the head plate and the bed plate there are received a large number of press plates with or without a simultaneous closing mechanism on the bed plate and each of the intermediate plates, a flat article to be pressed can be received.

In all of the aforedescribed presses, at least one and preferably both of the plates between which an article is sandwiched, can be heated by passing a heating fluid, e.g. superheated steam, through passages in the plate between an inlet and an outlet.

The presses can be used for the production of pressed-board in which a flat collection of fibers or other particles of wood or other cellulosic material, with or without binder, is hot pressed into a coherent slab. The collection of particles may be more or less coherent and may be in the form of a mat and the product may be used for a variety of purposes, depending on its composition and density, the latter being in part a function of the heating and pressing operation. For example, the pressed-board may be a low density highly porous, light weightparticleboard which can be used primarily for insulation and for structural purpose in which the board does not constitute a load-bearing element.

The systems can be used also for the production of high-density, high-strength particleboard which is not only self-supportive, but is load-bearing and weather-resistant. Naturally, the entire range of particleboard applications between those described can be provided as well.

The presses can also be used for finishing particleboard or for the fabrication of laminated board by using the hot pressing action to bind one or more surface-finishing or decorative layers to a core or substrate, e.g. of particleboard, by lamination techniques.

Presses of the type described have also been used to form from superposed layers, e.g. of wood or combination of wood and synthetic resin materials and for the production of synthetic resin or rubber boards, slabs or belts (e.g. conveyor belts).

The heating plates or platens of the presses can have the heating-fluid passages in the form of mutually parallel bores of generally circular cross section. The bores may be provided in pairs separated by regions of small wall thickness with the pairs of bores being separated by walls of larger thickness so that, in cross section, the partitions between the bores have the appearance of hyperboloids.

With presses in which heating and cooling alternate and in which the cooling is effected by forcing water through the passages previously traversed by superheated steam, it is found that a homogeneous temperature distribution is difficult, if not impossible to maintain in conventional press plates of the aforedescribed type.

The failure to maintain a homogeneous temperature distribution seriously affects the quality of the products made e.g. can lead to warping, products with lack of isotropy in various portions, various surface-finish defects which cannot be removed by subsequent treatments or which can only be removed by expensive and time-consuming procedures.

In the prior art systems of the aforedescribed type, the partitions or walls between the bores tended to terminate immediately at the points at which the bores opened into the chambers at which the fluid was deflected from flow in one direction to flow in the opposite direction, i.e. from one pair of bores into the next pair of bores. In other words, the thick partition between pairs of bores and the thin partitions between the bores of each pair terminated in the same plane perpendicular to the plane of the plate. Furthermore, all of the edges contacted by the fluid in the region of each direction-changing chamber were usually rounded.

OBJECT OF THE INVENTION

It is the object of the present invention to provide an improved press plate in which the disadvantages of the earlier system are obviated.

SUMMARY OF THE INVENTION

It has now been discovered that a principal reason for the temperature in homogeneity of the prior art press plates of the aforementioned construction is the inability to bring about temperature homogenization in the transition between flow from one pair of bores to flow in the next pair of bores in spite of the fact that one would expect the free space of the connecting chamber to ensure such homogenization.

More particularly, it has been found that lack of uniformity in the temperature distribution is due to the relationship of the partitions between the passage of each pair to the chamber and the partition between the pairs of passages to which the chamber is common.

According to the invention, the thin partitions between the passages of each pair are set back from the respective chamber, i.e. the end of the thick partition between the pairs of passages to which the chamber is common, by a multiple of the diameter of the circular-section bores forming the passages to define between the end of each thin partition or wall and a respective chamber, a mixing or turbulent-flow compartment in which the two bores of each pair communicate with one another.

Surprisingly, the elimination of the thin partition or wall between the paired bores in the proximity of the direction-changing chamber eliminates temperature differentials in the plate which might otherwise arise and, when the heating fluid is superheated steam, the temperature distribution over the entire plate is practically uniform.

While the reasons for this surprising improvement are not completely understood, it appears that in part, the problem may arise from the fact that condensate forming upon the abstraction of heat from the plate may centrifugally concentrate in the outer passage of the pair into which the heating fluid sweeps as its direction is changed in the flow chamber, thereby reducing the heating efficiency in one of the passages of each pair after each flow-direction change.

Since the heating effect may be less in one of the passages of each pair because of this phenomenon, condensate formation therein may be more pronounced and the problem multiplied as the heating medium flows from the inlet side to the outlet side of the system.

Whatever the reason, the system of the invention which allows communication between the passages of each pair over a region upstream and downstream of each flow-direction chamber through a distance which is at least twice the diameter of the passage and preferably three or more times this diameter but less than five times the diameter, solves the problem. The mixing and turbulent flow in these partition-free zones may result in reevaporation of the condensate in whole or in part or merely redistribution of fluid so that the flow through subsequent passages of each pair is uniform.

According to a preferred feature of the invention, the thin web or partition, at its narrowest region, has a wall thickness smaller than half the radius of the bore while, conversely, the thick partition has a thickness in its narrowest region which is greater than the radius of the bore but preferably less than the diameter thereof although it can approach the diameter in thickness.

To promote turbulent flow in the aforementioned zones, all of the edges, ends and corners in the zones should be sharp and unrounded, and it has been found to be advantageous, where the thin partition or wall is interrupted, to provide upper and lower ribs which project toward one another but do not touch, which are formed with sharp unrounded edges and ends.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
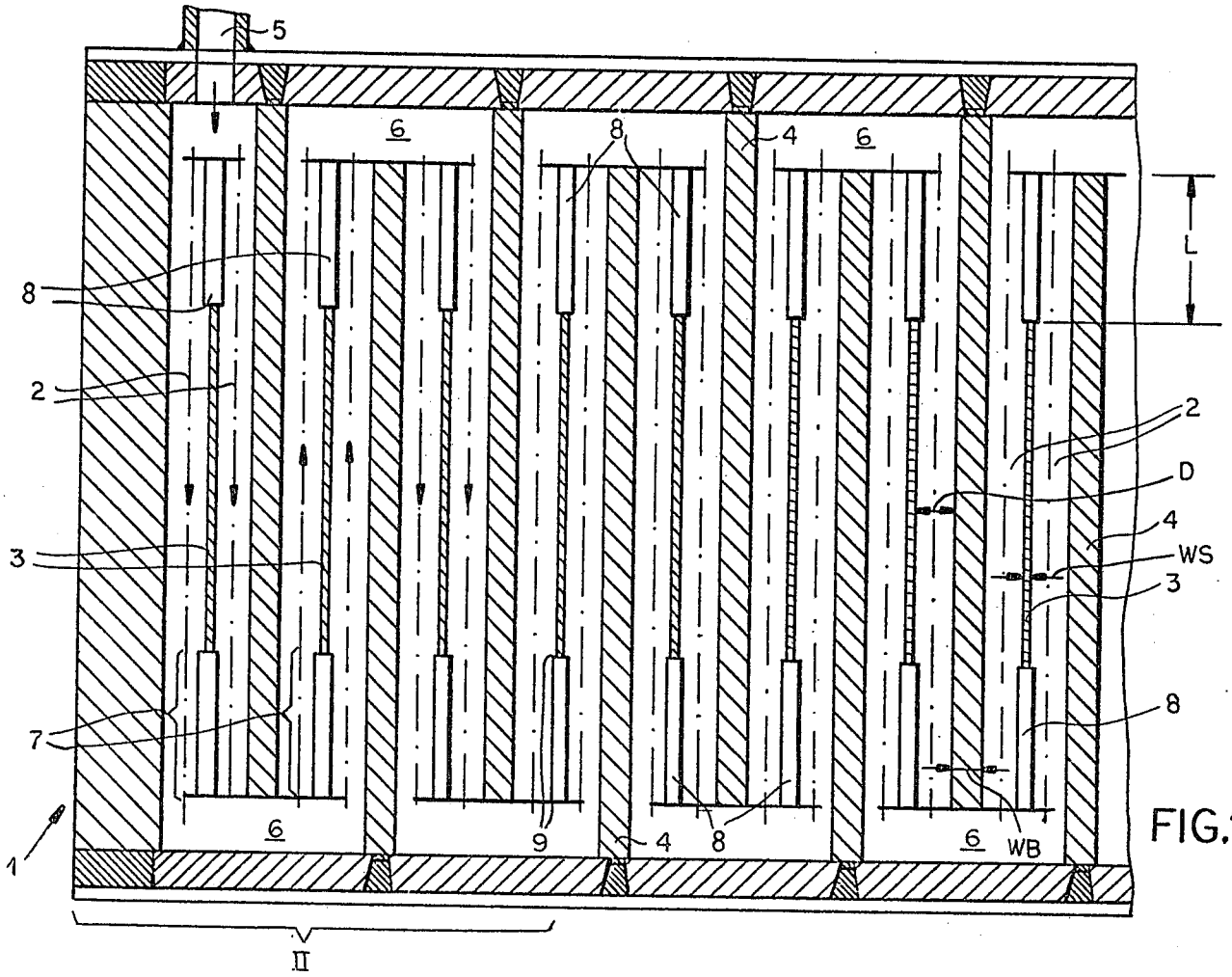
FIG. 1 is a partial cross section at the inlet side of a heating press plate according to the invention, the section taken through a median plane parallel to the plate.
Figure 2:
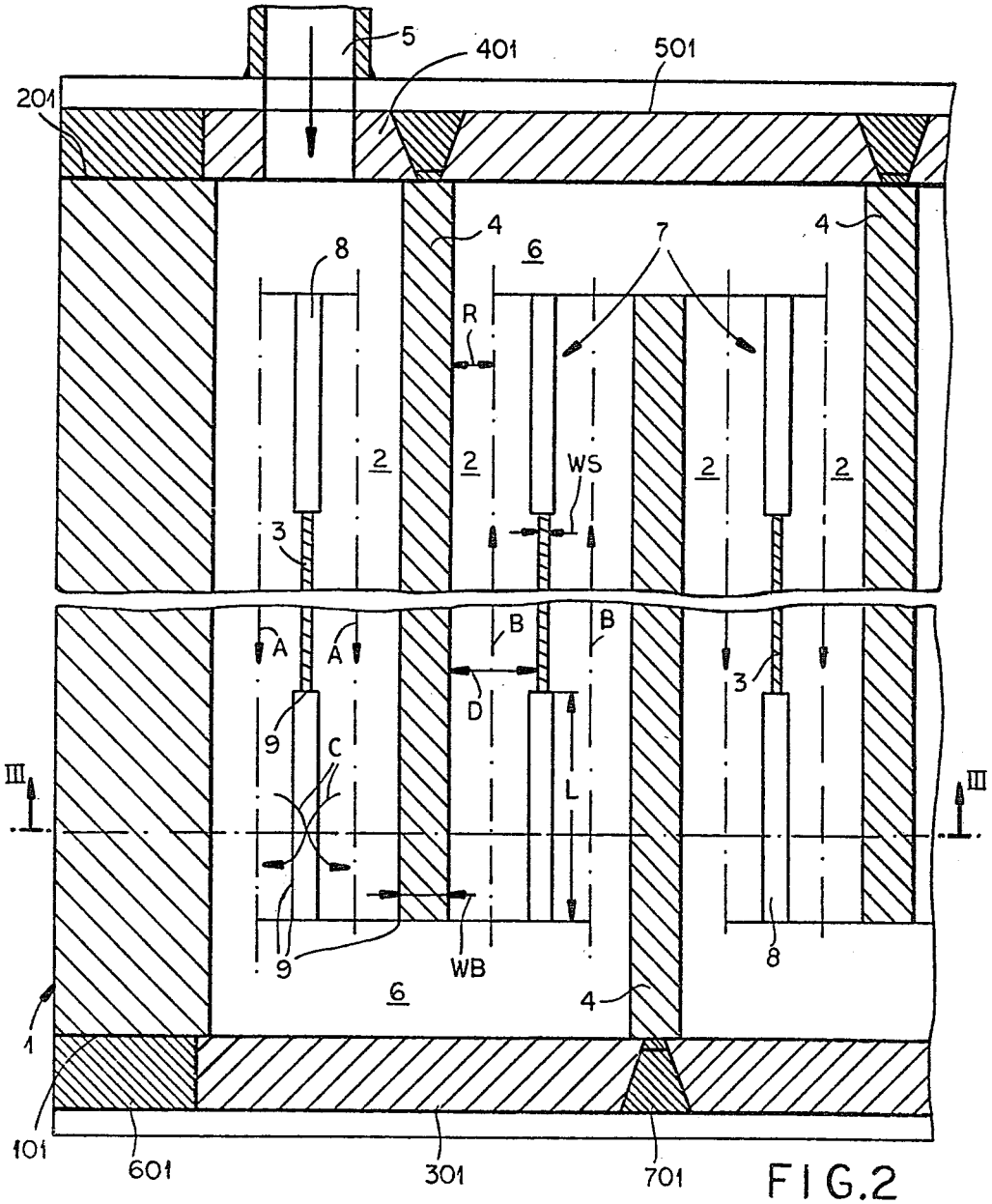
FIG. 2 is an enlarged detail view of the inlet portion of the plate.

The plate shown in the drawing has been illustrated somewhat diagrammatically and can be used as a head plate, bed plate or intermediate plate in any of the platen press systems described. FIG. 2, of course, shows the region II of FIG. 1 and, while the fluid control means has not been illustrated, it will be apparent that the inlet and outlet can be connected in a superheated steam recirculating system, to a source of cooling water, or the like.

Figure 3:
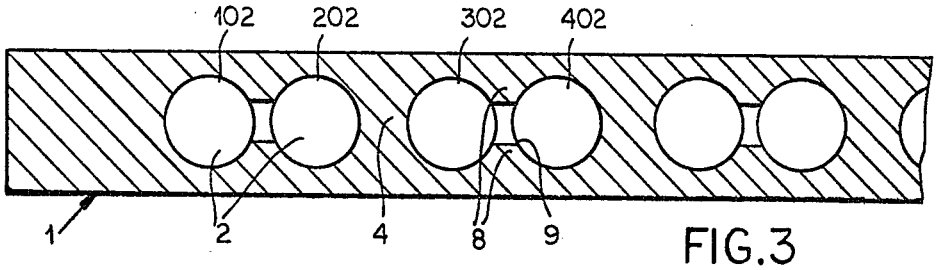
FIG. 3 is a cross section taken generally along the line III—III of FIG. 2.

The plate 1 comprises a multiplicity of mutually parallel circular cross section bores 2 which are disposed in pairs as will be apparent from FIGS. 2 and 3. For example, the bores 102 and 202 form one pair in FIG. 3 while the bores 302 and 402 form an adjoining pair.

The bores of each pair are separated from one another by thin partition 3 unitary with the plate body while each pair of bores is separated from the adjoining pair by a thick partition 4 equally formed unitarily with the plate body.

The bores 2 may open along edges 101 and 201, bars 301, 401 and 501 sealing the edges and being welded at 601 or 701 to the plate body.

As can be seen from the arrows A and B, the passages of each pair conduct fluid condirectionally while the passages of adjoining pairs in opposite directions. The fluid is admitted through an inlet 5 mounted in alignment with a bore in the bar 401 and is discharged through an outlet 10.

According to the invention, the narrow wall or partition 3 is terminated short of the chambers 6 which interconnect the two adjoining pairs of passages alternately on opposite sides of the plate, by a distance L which is equal to nD where n is preferably an integer equal at least to 2 although it may have any value greater than 2. Thus, over the length L, a mixing zone is formed permitting fluid interchange as represented by the arrows C in a turbulent manner, this zone having a length which is a multiple of the diameter of the D of the bores.

The length L is measured inwardly from the chamber 6, at which the thick partitions 4 terminate.

Two adjoining mixing chambers or zones 7 are thus separated by each thick partition 4.

The thin partitions 3 have, at their narrowest regions, wall thicknesses WS which are preferably smaller than the $\frac{1}{2}$R or D/4 where R is the radius of the bores 2.

The thick partitions 4 have wall thicknesses WB which are greater than R but smaller than D.

Figure 4:
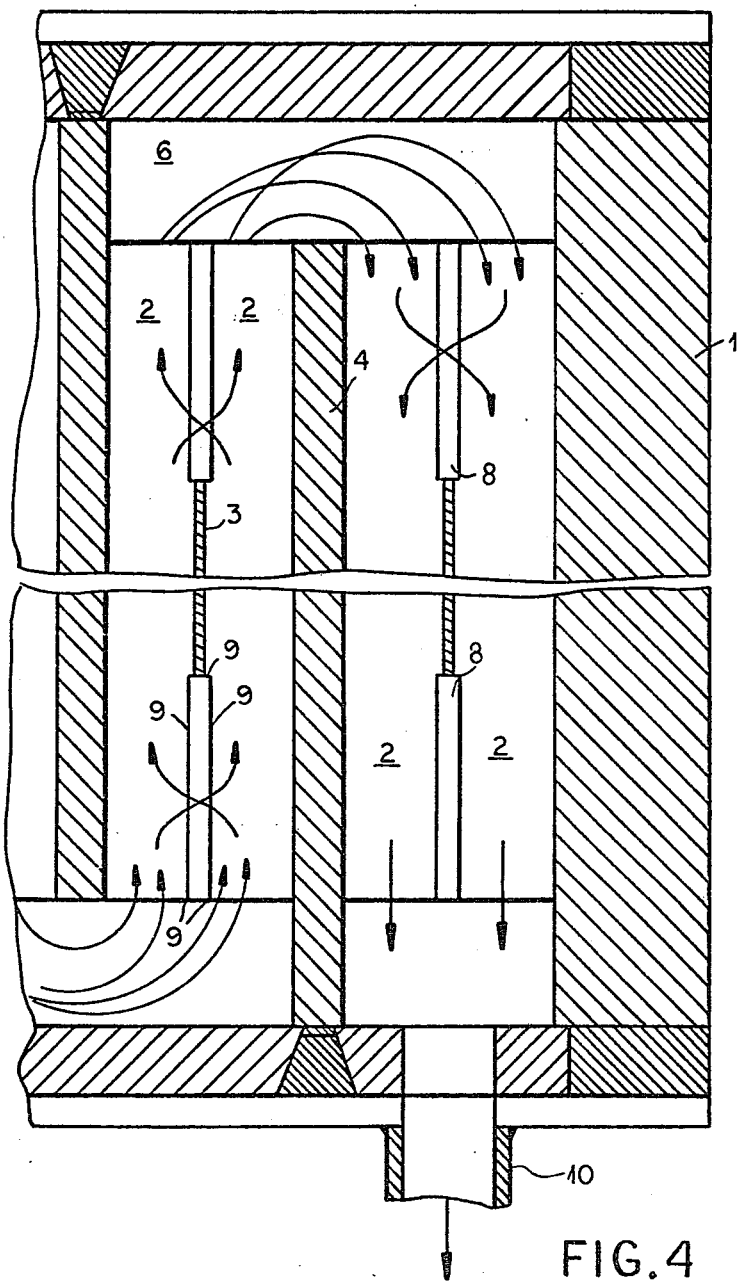
FIG. 4 is a view similar to FIG. 2 of the outlet region of the plate.

As is also apparent from the drawing and especially FIG. 4, where the narrow partitions 3 are interrupted or eliminated, the body of the plate is formed with ribs 8 which project from the top and the bottom toward one another and are formed with sharp edges 9 which, like the corners where these ribs terminate, are unrounded and promote turbulence in the manner described.

When the heating fluid is circulated through the plate, the fluid passes in the direction of the arrows and turbulence as represented by arrows C prevents temperature in homogeneities from arising.

I claim:

1. A heating press plate for a platen press comprising:

a plate body formed with a plurality of pairs of bores in mutually parallel spaced-apart relationship with the bores of each pair separated by respective thin walls and the adjoining pairs of bores separated by thick walls;

means for feeding a heating fluid to a first pair of bores;

means forming connecting chambers between adjoining pairs of bores alternately on opposite sides of said plate whereby said fluid flows in succession through the bores of successive pairs and codirectionally through the bores of each pair but in opposite directions through the bores of adjoining pairs; and means forming mixing zones enabling communication between the bores of each pair upstream and downwstream of each of said chambers.

2. The plate defined in claim 1 wherein each of said thin walls is terminated inwardly of the respective chamber by a distance which is a multiple of the bore diameter, said thick walls reaching to said chambers.

3. The plate defined in claim 2 wherein said thin walls have thicknesses at their narrowest points which are less than half the bore radius.

4. The plate defined in claim 2 wherein said thick walls have thicknesses at their narrowest points which are greater than the bore radius but less than the bore diameter.

5. The plate defined in claim 3 or claim 4, further comprising upwardly and downwardly extending ribs reaching from the ends of said thin walls to said chambers.

6. The plate defined in claim 5 wherein said ribs are formed with unrounded edges and corners.

* * * * *